United States Patent [19]

Arai et al.

[11] Patent Number: 4,989,048

[45] Date of Patent: Jan. 29, 1991

[54] CONTROL FOR RELEASING A CLEANING BLADE BASED ON THE PHOTOCONDUCTIVE ELEMENT TEMPERATURE

[75] Inventors: Makoto Arai; Yuichi Aoyama, both of Tokyo, Japan

[73] Assignee: Ricoh Company, Ltd., Tokyo, Japan

[21] Appl. No.: 326,512

[22] Filed: Mar. 21, 1989

[30] Foreign Application Priority Data

Apr. 6, 1988 [JP] Japan ..... 63-83114

[51] Int. Cl.[5] ..... G03G 21/00

[52] U.S. Cl. ..... 355/299; 15/256.52; 118/652; 355/297

[58] Field of Search ..... 355/296, 297, 299, 300, 355/301, 256; 118/652; 15/1.5 R, 256.51, 256.52

[56] References Cited

U.S. PATENT DOCUMENTS 4,278,345 7/1981 Davis ..... 355/256
4,279,501 7/1981 Kojima ..... 355/297
4,396,276 8/1983 Murasaki ..... 118/652
4,639,122 1/1987 Pease ..... 355/299

FOREIGN PATENT DOCUMENTS 0109853 8/1979 Japan ..... 355/256
0240989 10/1987 Japan ..... 355/296

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

A cleaning device for use in an electrophotographic copier, facsimile apparatus or similar image recorder for cleaning a photoconductive element to remove a toner which remains on the photoconductive element after image transfer. If the temperature of the photoconductive element is lower than 35 degrees centigrade, a cleaning blade is held in pressing contact with the photoconductive element after an image recording operation. If the temperature is 35 degrees centigrade or higher, the blade is released from the photoconductive element upon the lapse of a predetermined period of time after a copying operation.

9 Claims, 3 Drawing Sheets

CONTROL FOR RELEASING A CLEANING BLADE BASED ON THE PHOTOCONDUCTIVE ELEMENT TEMPERATURE

BACKGROUND OF THE INVENTION

The present invention relates to a cleaning device for use in an image recorder.

In an electrophotographic copier, facsimile apparatus or similar image recorder, a cleaning device is disposed in close proximity to an image carrier in the form of a drum so as to remove a toner which remains on the drum after image transfer. The cleaning device includes a cleaning blade which is pressed against the drum by a solenoid or similar urging means. Assuming that the surface of the drum is constituted by a selenium layer or a combination of selenium and tellurium layers, it remains relatively hard so long as the temperature of the drum is of a usual level. In this condition, leaving the cleaning blade in pressing contact with the drum surface is not critical. However, the temperature of the drum often rises by 15 degrees or so when the ambient temperature is high or when the drum is operated nearly continuously. When the cleaning blade is held in pressing contact with the surface of the drum while the drum temperature is as high as above 40 degrees, for example, the surface of the drum becoms soft to allow the edge of the cleaning blade to bite thereinto resulting in a linear concavity or trace being produced in and along the axis of the drum. This concavity in the drum surface appears on a reproduction as a black line. In addition, the edge of the cleaning blade drops in such a concavity while the image recorder is operated, producing noise. Especially, in a wet-process electrophotographic copier which uses a liquid developer, a toner firmly adhere to the drum surface so that a greater cleaning force than with a dry-process electrophotographic copier is required which would cause the cleaning blade to bite deeper into the drum surface.

In the light of this, it has been customary with an electrophotographic copier, for example, to deenergize the solenoid and thereby release the cleaning blade from the drum surface upon the lapse of a certain period of time (usually 15 minutes) after a copying operation. This, however, causes the cleaning blade to be brought into and out of contact with the drum surface frequently and thereby causes a substantial amount of toner to be scattered around and/or dropped from the cleaning blade to smear the interior of the copier.

SUMMARY OF THE INVENTION

It is therefore an object of the present invention to provide a cleaning device for an image recorder which frees the interior of an image recorder from contamination due to a toner by reducing the number of times that a cleaning blade is released from a drum surface.

It is another object of the present invention to provide a generally improved cleaning device for an image recorder.

A cleaning device for an image recorder having a photoconductive element and a cleaning blade which is pressingly engageable with the surface of the photoconductive element of the present invention comprises a sensor for sensing a temperature of the photoconductive element, and a controller for controlling, in response to a level of the sensed temperature, a period of time during which the cleaning blade is to be left in pressing contact with the photoconductive element after an image recording operation.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

A preferred embodiment of the cleaning device in accordance with the present invention will be described in detail hereinafter. In the following description, an image recorder is implemented as a wet-process electrophotographic copier having an image carrier in the form of a photoconductive drum in order to facilitate an understanding of the present invention.

Figure 1:
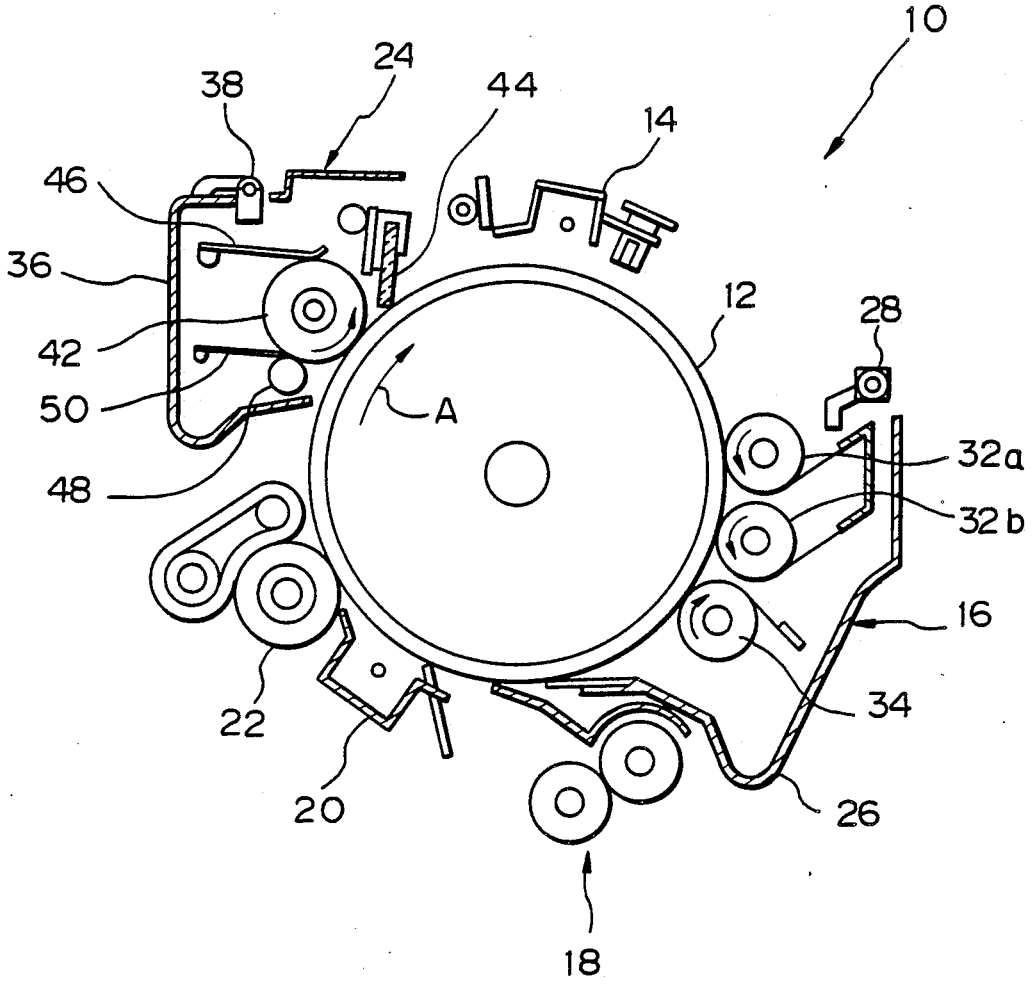
FIG. 1 is a section showing various structural elements of a wet-process electrophotographic copier which are arranged around an image carrier in the form of a photoconductive drum, the copier belonging to a family of image recorders with which the present invention is concerned.

Referring to FIG. 1 of the drawings, the electrophotographic copier, generally 10, has a photoconductive drum 12 and a main charger 14, a developing device 16, a register roller pair 18, an image transferring device 20, a paper separating device 22, and a cleaning device 24 which are arranged around the drum 12. The developing device 16 has a casing 26 which is provided with a developer inlet port 28 and a developer outlet port 30 (FIG. 2) at its upper end and lower end, respectively. A liquid developer is introduced into the casing 26 through the inlet port 28 and collected through the outlet port 30. Two developing rollers 32*a* and 32*b* and a squeeze roller 34 are arranged in the casing 26 along the periphery of the drum 12.

The cleaning device 24 has a casing 36 which is provided with a developer inlet port 38 and a developer outlet port 40 (FIG. 2) at its upper end and lower end, respectively. A cleaning roller 42 and a cleaning blade 44 are arranged in the casing 36 along the periphery of the drum 12. The cleaning blade 44 is operatively connected to a cleaning solenoid (not shown) by a motion transmitting mechanism (not shown). The edge of the cleaning blade 44 is brought into contact with the surface of the drum 12 when the cleaning solenoid is turned on, and it is released from the drum 12 when the solenoid is turned off. Also shown in FIG. 1 are a plate 46 for distributing a liquid developer, a squeeze roller 48, and a guide 50 for collecting the developer.

Figure 2:
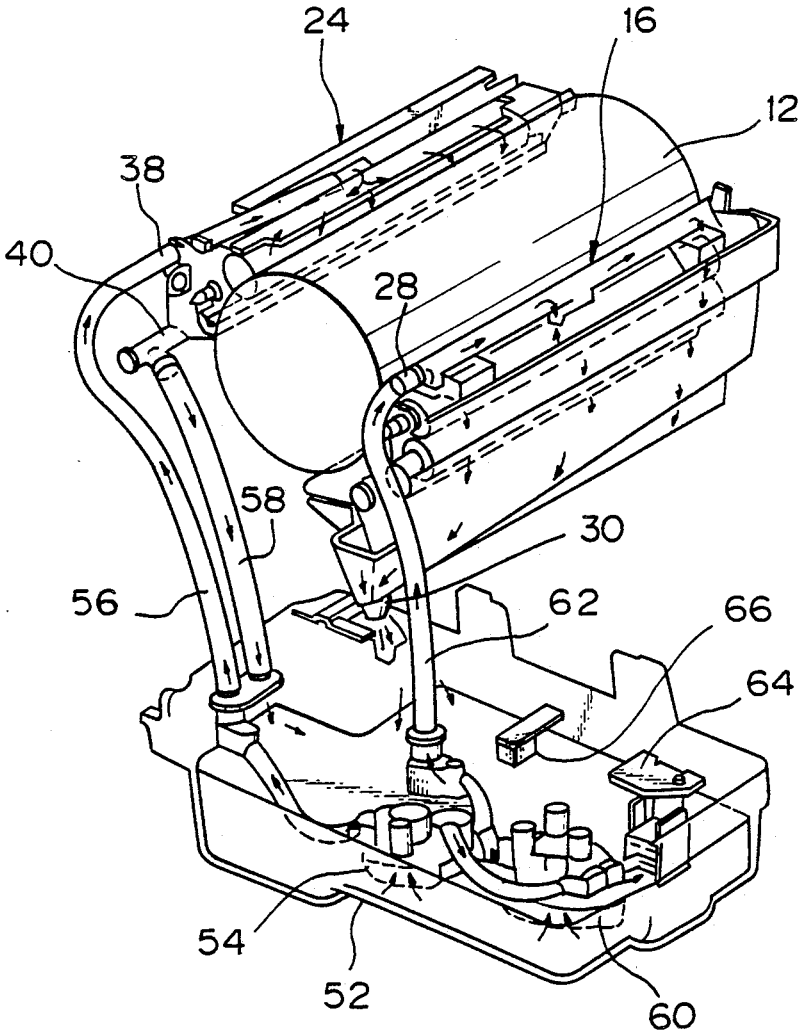
FIG. 2 is a perspective view showing how a liquid developer is circulated in the copier of FIG. 1.

As shown in FIG. 2, a developer tank 52 storing a liquid developer therein is provided. A cleaning pump 54 is disposed in the developer tank 52 to compress the liquid developer. The compressed developer is fed to the cleaning device 24 by way of a conduit 56 and the inlet port 38, while the collected developer is returned to the developer tank 52 by way of the outlet port 40 and a conduit 58. A developing pump 60 supplies the liquid developer to the developing unit 16 via a conduit 62 and the inlet 28, while the collected developer is returned to the developer tank 52 via the outlet port 30. The reference numeral 64 designates a sensor responsive to the density of the developer.

The construction and arrangement described so far are substantially similar to those of an ordinary copier. In the illustrative embodiment, a temperature sensor 66 is located in the developer tank 52 to sense the temperature of the drum 12. In the case of a wet-process developing device, a liquid developer is repetitively fed from the developer tank 52 to the developing device 16 and cleaning device 24 and then returned to the tank 52, as previously stated. During such circulation, the developer is constantly held in contact with the drum 12 and therefore reaches the same temperature as the surface of the drum 12 in a period of time associated with the number of copies produced. Hence, the temperature of the drum 12 can be determined in terms of the temperature of the developer which is sensed by the sensor 66. In this embodiment, the period of time during which the cleaning blade 44 is to remain in pressing contact with the surface of the drum 12 after a copying operation is controlled in association with the temperature level of the surface of the drum 12 which is sensed by the temperature sensor 66. To practice such control, a series of experiments were conducted to observe the traces of a blade edge on a photoconductive drum by using a drum temperature and a blade pressing time as parameters. The drum used for the experiments was of the kind having a selenium layer and tellurium layer. The results are shown in Table 1 below.

TABLE 1

| | BLADE CONTACT TIME | | | |
|---|---|---|---|---|
| DRUM TEMP | 15 MIN | 30 MIN | 60 MIN | 120 MIN |
| 30° C. | | | | |
| 35° C. | | | | |
| 40° C. | X | X | X | X |

In Table 1, a circle, a cross, and a combined circle and cross show respectively that no edge trace was produced on the drum, that an edge trace was produced, and that an edge trace was produced but did not degrade a reproduction.

As shown in Table 1, the reference temperature which decides whether or not an edge trace occurs on the drum is 35 degrees centrigrade. In the light of this, in the illustrative embodiment, the cleaning blade 44 is controlled such that it is held in contact with the drum 12 even after a copying operation if the drum temperature is lower than 35 degrees centigrade and it is released from the drum 12 upon the lapse of a predetermined period of time (15 minutes or so) after the end of a copying operation if the drum temperature is 35 degrees centigrade or higher. In the latter condition, should the cleaning blade 44 be released from the drum 12 immediately after a copying operation, a substantial amount of developer would drop from the blade 44.

Figure 3:
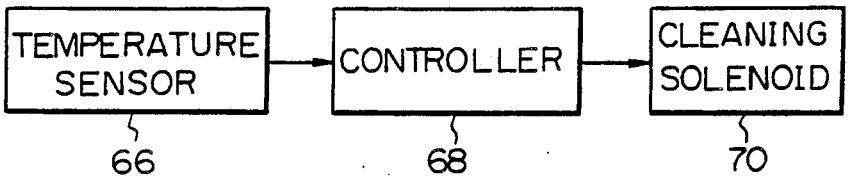
FIG. 3 is a schematic block diagram showing a control system in accordance with the present invention.
Figure 4:
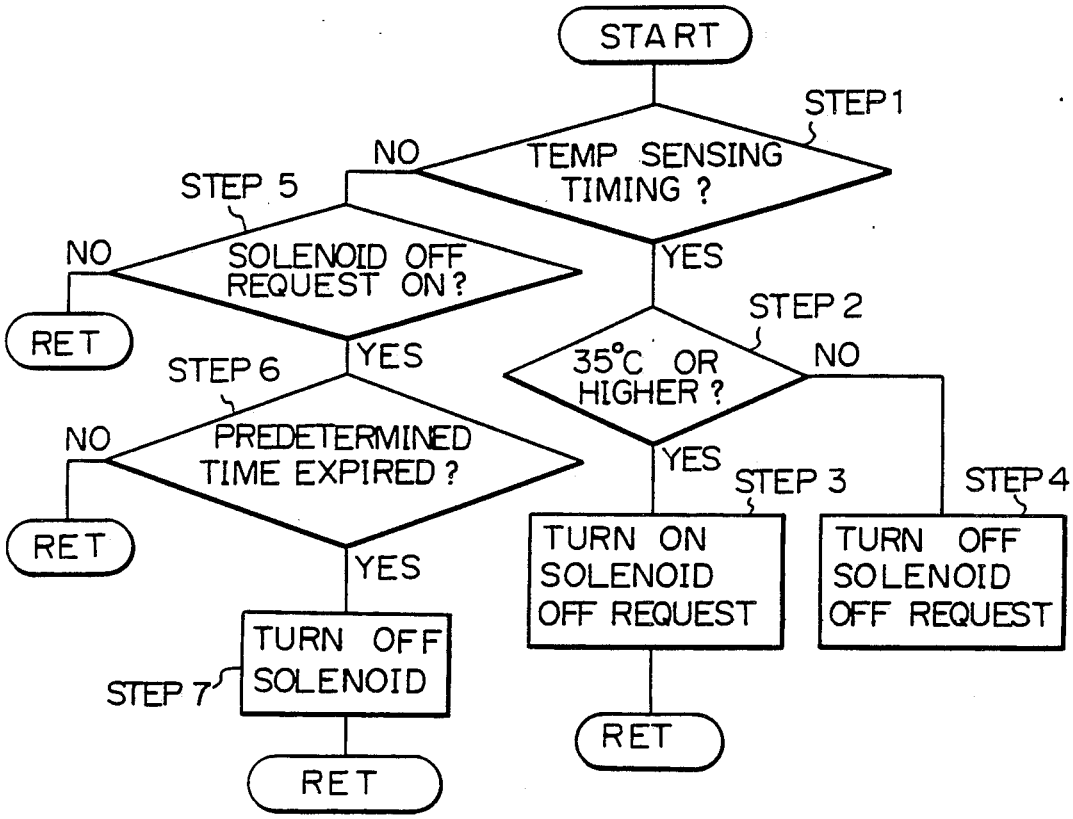
FIG. 4 is a flowchart demonstrating the operation of the control system shown in FIG. 3.

How to control the period of time for the blade to remain in contact with the drum 12 will be discussed more specifically with reference to FIGS. 3 and 4.

Preferably, the temperature sensor 66 senses the temperature of the developer, i.e., the temperature of the drum 12 at a certain time between a time just before the end of copying, at which the temperature of the drum 12 is highest, and a time just after the stop of rotation of the drum 12. An output of the temperature sensor 66 is fed to a controller 68 (STEP 1). In response, the controller 68 determines whether or not the sensed temperature is higher than the reference temperature, i.e. 35 degrees (STEP 2). If the answer of the STEP 2 is YES, the controller 68 turns on a solenoid OFF request associated with the cleaning blade 44 (STEP 3); if the answer of the STEP 2 is NO, the controller 68 does not turn it on (STEP 4). After the temperature sensing timing, the controller 68 sees if the solenoid OFF request has been turned on (STEP 5). If the answer of the STEP 5 is YES, the controller 68 delivers an OFF signal to the cleaning solenoid 70 upon the lapse of a predetermined period of time (STEP 7), thereby releasing the cleaning blade 44 from the drum 12.

By the above procedure, the number of times that the cleaning blade 44 is released from the drum 12 is reduced to in turn reduce the frequency that the toner is scattered around. Especially, in a wet-process developing device, the liquid developer accumulated on the edge of the cleaning blade 44 in the form of concentrated toner is prevented from firmly adhering thereto unless the blade 44 is maintained in contact with the drum 12 for two hours or so. This eliminates the need for a precleaning step otherwise required at the start of copying and thereby reduces the copying time. Should the cleaning blade 44 be released from the drum 12, the concentrated toner would become spread on the drum 12 and firmly adhere to the latter in the form of a thin layer, resulting in the need for a precleaning time which would add to the copying time.

A precleaning time was measured with the control system of the illustrative embodiment and a prior art system, the results being shown in Table 2 below.

TABLE 2

| BLADE CONTACT TIME | PRIOR ART | EMBODIMENT | |
|---|---|---|---|
| | | BELOW 35° C. | 35° C. OR ABOVE |
| 0–15 MIN | 0 SEC | 0 SEC | 0 SEC |
| 15–30 MIN | 5 SEC | 0 SEC | 5 SEC |
| 30–60 MIN | 10 SEC | 0 SEC | 10 SEC |
| 60–120 MIN | 15 SEC | 0 SEC | 15 SEC |
| ABOVE 120 MIN | 30 SEC | 30 SEC | 30 SEC |

A copying operation is usually ended within 2 hours, and a photoconductive drum is in many cases operated at temperatures below 35 degrees centigrade. It will therefore be seen that the control system of the illustrative embodiment reduces the waiting time ascribable to precleaning, compared to the prior art system.

While the illustrative embodiment has been shown and described as using a single reference temperature which defines two different temperature ranges for the control of the duration of contact of the cleaning blade 44, two different reference temperatures may be adopted to define three temperature ranges, if desired.

The temperature sensor 66 may be implemented by a non-contact type sensor which is located in the vicinity of the drum 12.

It is to be noted that the embodiment shown and described is applicable not only to a wet-process electrophotographic copier but also to a dry process electrophotographic copier.

In summary, it will be seen that in accordance with the present invention the period of time during which a cleaning blade remains in pressing contact with the surface of a photoconductive element is controlled on the basis of a sensed temperature of the photoconductive element. This allows the cleaning blade to be left in contact with the photoconductive elements at those temperatures which do not require the release of the blade. The resulting decrease in the frequency of release is successful in allowing a minimum of toner scattering to occur and reducing the frequency of the drop of toner accumulated on the edge of the blade, whereby the interior of a machine is maintained free from smears. Further, in the case of a wet-process electrophotographic copier, a liquid developer accumulating on the edge of the blade is prevented from firmly adhering to the latter, so that the precleaning time required is reduced.

Various modifications will become possible for those skilled in the art after receiving the teachings of the present disclosure without departing from the scope thereof.

What is claimed is:

1. A cleaning device for an image recorder having a photoconductive element and a cleaning blade which is movable and can be brought into pressing contact with a surface of said photoconductive element, comprising:

sensor means for sensing a temperature of said photoconductive element; and control means for controlling, in response to a level of the sensed temperature, a period of time during which said cleaning blade is to be left in pressing contact with said photoconductive element after an image recording operation and such that said cleaning blade is maintained in pressing contact with said photoconductive element after an image recording operation if the sensed temperature is lower than at least one predetermined temperature, and to release said cleaning blade from said photoconductive element only upon lapse of a predetermined period of time after an image recording operation if the sensed temperature is equal to or higher than said predetermined temperature.

2. A cleaning device as claimed in claim 1, wherein said predetermined temperature is 35 degrees centigrade.

3. A cleaning device as claimed in claim 1, wherein said sensor senses the temperature at a predetermined time between a time immediately before an end of image recording and a time immediately after an end of movement of said photoconductive element.

4. A cleaning device as claimed in claim 1, wherein said image recorder comprises a wet-process electrophotographic copier, said image recorder further comprising a developer tank which stores a liquid developer, said sensor means being disposed in said developer tank.

5. A cleaning device as claimed in claim 1, wherein said sensor means is disposed in close proximity to said photoconductive element.

6. A cleaning device as claimed in claim 1, wherein said image recorder comprises an electrophotographic copier.

7. A cleaning device as claimed in claim 1, wherein said photoconductive element has a selenium layer and tellurium layer.

8. A cleaning device for an image recorder having a photoconductive element and a cleaning blade which is pressingly engageable with a surface of said photoconductive element, said photoconductive element having a selenium layer and a tellurium layer, said cleaning device comprising:

sensor means for sensing a temperature of said photoconductive element; and control means for controlling, in response to a level of the sensed temperature, a period of time during which said cleaning blade is to be left in pressing contact with said photoconductive element after an image recording operation and such that said cleaning blade is maintained in pressing contact with said photoconductive element after an image recording operation if the sensed temperature is lower than at least one predetermined temperature, and to release said cleaning blade from said photoconductive element only upon lapse of a predetermined period of time after an image recording operation if the sensed temperature is equal to or higher than said predetermined temperature.

9. A cleaning device for an image recorder having a photoconductive element and a cleaning blade which is pressingly engageable with a surface of said photoconductive element, said photoconductive element having a selenium layer and a tellurium layer, said cleaning device comprising:

sensor means for sensing a temperature of said photoconductive element; and control means for controlling, in response to a level of the sensed temperature, a period of time during which said cleaning blade is to be left in pressing contact with said photoconductive element after an image recording operation and such that said cleaning blade is maintained in pressing contact with said photoconductive element after an image recording operation if the sensed temperature is lower than 35 degrees centigrade, and to release said cleaning blade from said photoconductive element only upon lapse of a predetermined period of time after an image recording operation if the sensed temperature is equal to or higher than 35 degrees centigrade.

* * * * *